US005958668A

United States Patent [19]

Matsumoto et al.

[11] Patent Number: 5,958,668

[45] Date of Patent: Sep. 28, 1999

[54] RECORDING MATERIAL

[75] Inventors: Hirotaka Matsumoto; Kimi Ikeda, both of Shizuoka; Hisashi Okada, Kanagawa, all of Japan

[73] Assignee: Fuji Photo Film Co., Ltd., Kanagawa, Japan

[21] Appl. No.: 08/859,719

[22] Filed: May 21, 1997

[30] Foreign Application Priority Data

May 22, 1996 [JP] Japan ..... 8-127508

[51] Int. Cl.[6] ..... G03C 1/498

[52] U.S. Cl. ..... 430/619; 430/607; 430/611; 430/613; 430/614; 430/615; 430/617; 430/620

[58] Field of Search ..... 430/619, 617, 430/607, 611, 613, 614, 615, 620

[56] References Cited

U.S. PATENT DOCUMENTS

| | | | |
|---|---|---|---|
| 3,874,946 | 4/1975 | Costa et al. . | |
| 5,393,654 | 2/1995 | Burrows et al. | 430/617 |
| 5,424,182 | 6/1995 | Marginean, Sr. et al. . | |
| 5,527,757 | 6/1996 | Uyttendaele et al. . | |
| 5,527,758 | 6/1996 | Uyttendaele et al. . | |
| 5,656,419 | 8/1997 | Toya et al. | 430/617 |

*Primary Examiner*—Thorl Chea
*Attorney, Agent, or Firm*—Sughrue, Mion, Zinn, Macpeak & Seas, PLLC

[57] ABSTRACT

A recording medium comprising a support having thereon a recording layer comprising an organic silver salt, a developing agent for the organic silver salt, a water-soluble binder and an antifoggant in an amount of from 10 mol % to 40 mol % based on the organic silver salt. The recording material has a long shelf life and provides a high-density image.

4 Claims, No Drawings

RECORDING MATERIAL

FIELD OF THE INVENTION

The present invention relates to a recording material which forms an image by dry processing, and more particularly to a dry recording material which forms a silver image using an organic silver salt.

BACKGROUND OF THE INVENTION

The product called "dry silver" developed by Minnesota Mining and Manufacturing Co., U.S.A. is well known as the dry processing photographic material which overcame the drawbacks of silver halide wet processing while maintaining the photosensitivity, gradation and good image quality of silver halides.

Dry silver contains silver behenate which is a light-stable, colorless or white organic silver salt, and produces a silver image by the redox reaction when heated together with a reducing agent to 100° C. or more. Silver behenate is one of the indispensable components of Dry silver.

The dry silver photographic material is generally prepared by coating on a support with the solution composed of a polymer dispersion of an organic silver salt in adding a silver halide forming agent, in which a part of the organic silver salt has been converted to a silver halide, a reducing agent (developing agent) and various additives. Alternatively, the dry silver photographic material may be prepared by coating on a support with the solution composed of a polymer dispersion of organic silver salt, a silver halide that has been separately prepared previously, a reducing agent (developing agent) and various additives. The above coating is followed by drying, to form a light-sensitive layer. In this material, an image can be formed using a thermal head, regardless of the presence or absence of the silver halide. That is, the dry silver recording material can also be used as a thermal recording material.

The image layers of such recording materials are advantageous in that the increased concentration of organic silver salts contained therein for obtaining high-density images allows the redox reaction to proceed at ordinary temperatures. In turn, this reduces shelf life. In order to enhance the shelf life, the use of antifoggants is known. However, the use of antifoggants in large amounts for obtaining a sufficient antifogging effect is problematic in that dynamic color development, one of indices of color development, is deteriorated. Furthermore, organic solvent coating solutions used to prepare the above-mentioned dry silver photographic materials present a problem that explosion-proof equipment is required.

SUMMARY OF THE INVENTION

It is therefore an object of the present invention to provide a recording material which exhibits little fogging and which concurrently provides excellent dynamic color development.

Other objects and effects of the present invention will become apparent from the following description.

The present inventors have conducted extensive studies in order to solve the above-described problems of the prior art. As a result, the present inventors have discovered that the above objective is achieved by providing a recording medium comprising a support having thereon a recording layer comprising an organic silver salt, a developing agent for the organic silver salt, a water-soluble binder and an antifoggant in an amount of from 10 mol % to 40 mol % based on said organic silver salt contained in the recording layer. The amount of the antifoggant is preferably from 20 mol % to 40 mol % based on the amount of the organic silver salt. If the content of the antifoggant is less than 10 mol % based on the organic silver salt, the antifogging effect is insufficient. Amounts exceeding 40 mol % unfavorably deteriorate the dynamic color development.

DETAILED DESCRIPTION OF THE INVENTION

The present invention is described in detail below.

The antifoggant for use in the present invention includes known antifoggants. However, compounds represented by the following general formulae (A) to (F), particularly general formulae (E) and (F), are preferred:

General Formula (A)

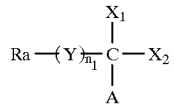

General Formula (B)

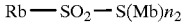

General Formula (C)

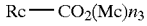

General Formula (D)

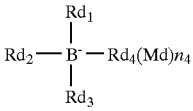

General Formula (E)

and

General Formula (F)

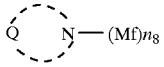

In general formula (A), Ra represents an aliphatic hydrocarbon group, an aryl group or a heterocyclic group, Y represents —CO—, —SO— or —$SO_2$—, $n_1$ represents 0 or 1, $X_1$ and $X_2$ each represents a halogen atom, and A represents a hydrogen atom or an electron attractive group.

In general formula (B), Rb represents an aliphatic hydrocarbon group, an aryl group or a heterocyclic group, Mb represents a hydrogen atom or a cation, and $n_2$ represents a number selected to make a neutral molecule.

In general formula (C), Rc represents an aliphatic hydrocarbon group, an aryl group or a heterocyclic group, Mc represents a hydrogen atom or a cation, and $n_3$ represents a number selected to provide a neutral molecule.

In general formula (D), $Rd_1$, $Rd_2$, $Rd_3$ and $Rd_4$ each represents an aliphatic hydrocarbon group, an aryl group or a heterocyclic group, Md represents a cation, and $n_4$ represents a number selected to provide a neutral molecule.

In general formula (E), Re represents an aliphatic hydrocarbon group, an aryl group or a heterocyclic group, Me represents a hydrogen atom or a cation, and $n_5$ represents a number selected to provide a neutral molecule.

In general formula (F), Q represents an atomic group which forms a nitrogen-containing heterocyclic group, Mf represents a hydrogen atom or a cation, and $n_6$ represents a number selected to provide a neutral molecule.

The compounds represented by general formula (A) are described in detail below.

The aliphatic hydrocarbon group represented by Ra is a straight-chain, branched or cyclic alkyl group (preferably having from 1 to 30 carbon atoms, more preferably from 1 to 20 carbon atoms, and still more preferably from 1 to 16 carbon atoms; examples thereof include methyl, ethyl, iso-propyl, tert-propyl, n-octyl, n-decyl, n-hexadecyl, cyclopropyl, cyclopentyl and cyclohexyl), an alkenyl group (preferably having from 2 to 30 carbon atoms, more preferably from 2 to 20 carbon atoms, and still more preferably from 2 to 16 carbon atoms; examples thereof include vinyl, allyl, 2-butenyl and 3-pentenyl) and an alkynyl group (preferably having from 2 to 30 carbon atoms, more preferably from 2 to 20 carbon atoms, and still more preferably from 2 to 16 carbon atoms; examples thereof include propargyl and 3-pentynyl). The above groups may also be substituted with a substituent group. The aliphatic hydrocarbon group represented by Ra is preferably an alkyl group.

The aryl group represented by Ra may be a monocyclic ring or a condensed ring, and preferably is a bicyclic aryl group preferably having from 6 to 30 carbon atoms, more preferably from 6 to 20 carbon atoms and still more preferably from 6 to 16 carbon atoms (for example, phenyl or naphthyl), which may be substituted with a substituent group. The aryl group represented by Ra is preferably phenyl or naphthyl, and more preferably is phenyl.

The heterocyclic group represented by Ra is a 3- to 10-membered saturated or unsaturated heterocyclic group containing at least one of a nitrogen atom, an oxygen atom and a sulfur atom, which may be a monocyclic ring or may form a condensed ring with another ring.

The heterocyclic group represented by Ra is preferably a 5- or 6-membered unsaturated heterocyclic group, more preferably a 5- or 6-membered aromatic heterocyclic group, still more preferably a 5- or 6-membered nitrogen-containing aromatic heterocyclic group, and particularly preferably a 5- or 6-membered aromatic heterocyclic group containing 1 to 4 nitrogen atoms, which may be substituted with a substituent group.

Specific examples of the heterocyclic ring corresponding to the heterocyclic group represented by Ra include pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, indolenine and tetraazaindene.

The heterocyclic ring represented by Ra is preferably imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzothiazole, indolenine or tetraazaindene, more preferably pyridine, pyrimidine, pyrazine, pyridazine, triazole, triazine, thiadiazole, oxadiazole, quinoline, phthalazine, naphthyridine, quinoxaline, quinazoline, cinnoline, tetrazole, thiazole, oxazole, benzimidazole, benzoxazole, benzothiazole or tetraazaindene, and still more preferably triazine, thiadiazole, oxadiazole or quinoline.

Ra is particularly preferably a substituted or unsubstituted phenyl group, a substituted or unsubstituted triazine group, a substituted or unsubstituted thiadiazole group, a substituted or unsubstituted oxadiazole group or a substituted or unsubstituted quinoline group.

The substituent groups for the aliphatic hydrocarbon group, the aryl group and the heterocyclic group represented by Ra include, for example, alkyl groups (each preferably having from 1 to 20 carbon atoms, more preferably 1 to 12 carbon atoms, and particularly preferably 1 to 8 carbon atoms; examples thereof include methyl, ethyl, iso-propyl, tert-propyl, n-octyl, n-decyl, n-hexadecyl, cyclopropyl, cyclopentyl and cyclohexyl), alkenyl groups (each preferably having from 2 to 20 carbon atoms, more preferably 2 to 12 carbon atoms, and particularly preferably 2 to 8 carbon atoms; examples thereof include vinyl, allyl, 2-butenyl and 3-pentenyl), alkynyl groups (each preferably having from 2 to 20 carbon atoms, more preferably 2 to 12 carbon atoms, and particularly preferably 2 to 8 carbon atoms; examples thereof include propargyl and 3-pentynyl), aryl groups (each preferably having from 6 to 30 carbon atoms, more preferably 6 to 20 carbon atoms, and particularly preferably 6 to 12 carbon atoms; examples thereof include phenyl, p-methylphenyl and naphthyl), amino groups (each preferably having from 0 to 20 carbon atoms, more preferably 0 to 10 carbon atoms, and particularly preferably 0 to 6 carbon atoms; examples thereof include amino, methylamino, dimethylamino, diethylamino and dibenzylamino), alkoxyl groups (each preferably having from 1 to 20 carbon atoms, more preferably 1 to 12 carbon atoms, and particularly preferably 1 to 8 carbon atoms; examples thereof include methoxy, ethoxy and butoxy), aryloxy groups (each preferably having from 6 to 20 carbon atoms, more preferably 6 to 16 carbon atoms, and particularly preferably 6 to 12 carbon atoms; examples thereof include phenyloxy and 2-naphthyloxy), acyl groups (each preferably having from 1 to 20 carbon atoms, more preferably 1 to 16 carbon atoms, and particularly preferably 1 to 12 carbon atoms; examples thereof include acetyl, benzoyl, formyl and pivaloyl), alkoxycarbonyl groups (each preferably having from 2 to 20 carbon atoms, more preferably 2 to 16 carbon atoms, and particularly preferably 2 to 12 carbon atoms; examples thereof include methoxycarbonyl and ethoxycarbonyl), aryloxycarbonyl groups (each preferably having from 7 to 20 carbon atoms, more preferably 7 to 16 carbon atoms, and particularly preferably 7 to 10 carbon atoms; examples thereof include phenyloxycarbonyl), acyloxy groups (each preferably having from 2 to 20 carbon atoms, more preferably 2 to 16 carbon atoms, and particularly preferably 2 to 10 carbon atoms; examples thereof include acetoxy and benzoyloxy), acylamino groups (each preferably having from 2 to 20 carbon atoms, more preferably 2 to 16 carbon atoms, and particularly preferably 2 to 10 carbon atoms; examples thereof include acetylamino and benzoylamino), alkoxy-carbonylamino groups (each preferably having from 2 to 20 carbon atoms, more preferably 2 to 16 carbon atoms, and particularly preferably 2 to 12 carbon atoms; examples thereof include methoxycarbonylamino), aryloxycarbonylamino groups (each preferably having from 7 to 20 carbon atoms, more preferably 7 to 16 carbon atoms, and particularly preferably 7 to 12 carbon atoms; examples thereof include phenyloxycarbonylamino), sulfonylamino groups (each preferably having from 1 to 20 carbon atoms, more preferably 1 to 16 carbon atoms, and particularly preferably 1 to 12 carbon atoms; examples thereof include methanesulfonylamino and benzenesulfonylamino), sulfamoyl groups (each preferably having from 0 to 20 carbon atoms, more preferably 0 to 16 carbon atoms, and particularly preferably 0 to 12 carbon atoms; examples thereof include sulfamoyl, methylsulfamoyl, dimethylsulfamoyl and phenylsulfamoyl), carbamoyl groups (each preferably having from 1 to 20 carbon atoms, more preferably 1 to 16 carbon atoms, and particularly preferably 1 to 12 carbon atoms; examples thereof include carbamoyl, methylcarbamoyl, diethylcarbamoyl and phenylcarbamoyl), alkylthio groups (each preferably having from 1 to 20 carbon atoms, more preferably 1 to 16 carbon atoms, and particularly preferably 1 to 12 carbon atoms; examples thereof include methylthio and ethylthio), arylthio groups (each preferably having from 6 to 20 carbon atoms, more preferably 6 to 16 carbon atoms, and particularly preferably 6 to 12 carbon atoms; examples thereof include phenylthio), sulfonyl groups (each preferably having from 1 to 20 carbon atoms, more preferably 1 to 16 carbon atoms, and particularly preferably 1 to 12 carbon atoms; examples thereof include mesyl and tosyl), sulfinyl groups (each preferably having from 1 to 20 carbon atoms, more preferably 1 to 16 carbon atoms, and particularly preferably 1 to 12 carbon atoms; examples thereof include methanesulfinyl and benzenesulfinyl), ureido groups (each preferably having from 1 to 20 carbon atoms, more preferably 1 to 16 carbon atoms, and particularly preferably 1 to 12 carbon atoms; examples thereof include ureido, methylureido and phenylureido), phosphoric acid amido groups (each preferably having from 1 to 20 carbon atoms, more preferably 1 to 16 carbon atoms, and particularly preferably 1 to 12 carbon atoms; examples thereof include diethylphosphoric acid amido and phenylphosphoric acid amido), a hydroxyl group, a mercapto group, halogen atoms (for example, fluorine, chlorine, bromine and iodine), a cyano group, a sulfo group, a carboxyl group, a nitro group, a hydroxamic acid group, a sulfino group, a hydrazino group, and heterocyclic groups (for example, imidazolyl, pyridyl, furyl, piperidyl and morpholino). These substituent groups may be further substituted. When two or more substituent groups are present, they may be the same or different.

The further substituent groups (i.e., substituents of the substituent groups) preferably include alkyl groups, aralkyl groups, alkenyl groups, alkynyl groups, aryl groups, alkoxyl groups, aryloxy groups, acyl groups, alkoxy-carbonyl groups, aryloxycarbonyl groups, acyloxy groups, acylamino groups, alkoxycarbonylamino groups, aryloxycarbonylamino groups, sulfonylamino groups, sulfamoyl groups, carbamoyl groups, ureido groups, a hydroxyl group, halogen atoms, a cyano group, a sulfo group, a carboxyl group, a nitro group and heterocyclic groups, more preferably alkyl groups, aralkyl groups, alkenyl groups, alkynyl groups, aryl groups, alkoxyl groups, aryloxy groups, acyl groups, alkoxy-carbonyl groups, aryloxycarbonyl groups, acyloxy groups, a hydroxyl group, halogen atoms, a cyano group and heterocyclic groups, and still more preferably alkyl groups, alkynyl groups and aryl groups.

Y represents —CO—, —SO— or —$SO_2$—, preferably —CO— or —$SO_2$—, and more preferably —$SO_2$—. $n_1$ represents 0 or 1.

The halogen atoms represented by $X_1$ and $X_2$, which may be the same or different, are preferably fluorine, chlorine, bromine and iodine atoms, preferably chlorine, bromine and iodine atoms, and more preferably chlorine and bromine atoms.

The electron attractive group represented by A is preferably a substituent group having a Hammett substituent constant (σp value) of 0.01 or more, and more preferably a substituent group having a Hammett substituent constant of 0.1 or more. For the Hammett substituent constant, reference can be made to *Journal of Medical Chemistry,* 16(11), 1207–1216 (1973). Such electron attractive groups include, for example, halogen atoms (fluorine (σp value: 0.06), chlorine (σp value: 0.23), bromine (σp value: 0.23) and iodine (up value: 0.18)), trihalomethyl groups (tribromomethyl (Op value: 0.29), trichloromethyl (σp value: 0.33) and trifluoromethyl (σp value: 0.54)), a cyano group (σp value: 0.66), a nitro group (σp value: 0.78), aliphatic, aryl or heterocyclic sulfonyl groups (for example, methanesulfonyl (σp value: 0.72)), aliphatic, aryl or heterocyclic acyl groups (for example, acetyl (σp value: 0.50) and benzoyl (σp value: 0.43)), alkenyl groups (for example, 3,4-(CH=CHCH=CH) (σp value: 0.04)), alkynyl groups (for example, $C_3H_3$ (σp value: 0.09), aliphatic, aryl or heterocyclic oxycarbonyl groups (for example, methoxycarbonyl σp value: 0.45) and phenoxycarbonyl (σp value: 0.45)), a carbamoyl group (σp value: 0.36) and a sulfamoyl group (σp value: 0.57).

The electron attractive group represented by A is preferably a halogen atom, an aliphatic, aryl or heterocyclic sulfonyl group, an aliphatic, aryl or heterocyclic acyl group or an aliphatic, aryl or heterocyclic oxycarbonyl group, more preferably a halogen atom or an aliphatic aryl or heterocyclic oxycarbonyl group, and particularly preferably chlorine, bromine or methoxycarbonyl.

Of the compounds represented by general formula (A), compounds represented by general formulae (a-1), (a-2), (a-3), (a-4) or (a-5) are preferred.

(a-1)

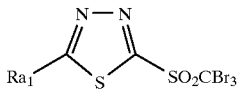

(a-2)

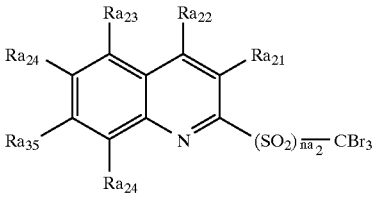

(a-3)

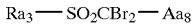

(a-4)

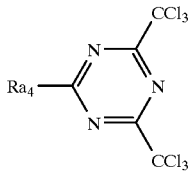

(a-5)

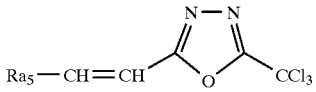

In the general formula (a-1) above, $Ra_1$ represents an aliphatic hydrocarbon group, an aryl group or a heterocyclic group, and has the same meaning as given for the aliphatic hydrocarbon group, the aryl group or the heterocyclic group, respectively, in general formula (A). $Ra_1$ is preferably an aliphatic hydrocarbon group, more preferably a straight-chain, branched or cyclic alkyl group having from 1 to 20 carbon atoms, still preferably an alkyl group having from 1 to 10 carbon atoms, still further preferably a straight-chain alkyl group having from 1 to 6 carbon atoms, and particularly preferably a methyl group.

In general formula (a-2), $Ra_{21}$, $Ra_{22}$, $Ra_{23}$, $Ra_{24}$, $Ra_{25}$ and $Ra_{26}$ each are a hydrogen atom or a group described as being a substituent group for the aliphatic hydrocarbon group, the aryl group or the heterocyclic group represented by Ra in general formula (A). $Ra_{21}$, $Ra_{22}$, $Ra_{23}$, $Ra_{24}$, $Ra_{25}$ and $Ra_{26}$ may combine to form a ring. $Ra_{21}$, $Ra_{22}$, $Ra_{23}$, $Ra_{24}$, $Ra_{25}$ and $Ra_{26}$ each are preferably a hydrogen atom. $na_2$ represents 0 or 1, and preferably 0.

In general formula (a-3), $Ra_3$ represents an aryl group. $Aa_3$ is a halogen atom or an aliphatic, aryl or heterocyclic oxycarbonyl group. The aryl group represented by $Ra_3$ has the same meaning as given for the aryl group represented by Ra in general formula (A), and is preferably a substituted or unsubstituted phenyl group, and more preferably a phenyl group or a 4-methylphenyl group. The halogen atom represented by $Aa_3$ is preferably a bromine atom. The aliphatic, aryl or heterocyclic oxycarbonyl group represented by $Aa_3$ is preferably an alkoxycarbonyl group, and more preferably a methoxycarbonyl group.

In general formula (a-4), $Ra_4$ represents an aryl group. The aryl group represented by $Ra_4$ has the same meaning as given for the aryl group represented by Ra in general formula (A), and is preferably a substituted or unsubstituted phenyl group, more preferably a phenyl group or a phenyl group substituted by an electron attractive group, and still more preferably a 4-trifluoromethylphenyl group.

In general formula (a-5), $Ra_5$ represents an aryl group. The aryl group represented by $Ra_5$ has the same meaning as given for the aryl group represented by Ra in general formula (A), and is preferably a substituted or unsubstituted phenyl group, more preferably a phenyl group or an alkoxy-substituted phenyl group, and still more preferably a 4-butoxyphenyl group. The ethylene group in formula (a-5) preferably has a trans form.

Next, the compounds represented by general formula (B) are described in detail below.

The aliphatic hydrocarbon group, the aryl group or Ad the heterocyclic group represented by Rb has the same meaning as given for the corresponding groups represented by Ra in general formula (A). Rb is preferably an aryl group, more preferably a substituted or unsubstituted phenyl or naphthyl group, and still more preferably a phenyl group.

The cation represented by Mb is an organic or inorganic cation. Examples thereof include alkali metal ions (such as $Li^+$, $Na^+$, $K^+$ and $Cs^+$), alkaline earth metal ions (such as $Mg^{+2}$ and $Ca^{+2}$), ammonium ions (such as ammonium, trimethylammonium, triethylammonium, tetramethylammonium, tetraethylammonium, tetrabutylammonium and 1,2-ethane-diammonium ions), pyridinium ions, imidazolium ions and phosphonium ions (such as a tetrabutylphosphonium ion). Mb is preferably an alkali metal ion, more preferably $Na^+$ or $K^+$, and still more preferably $Na^+$.

$n_2$ represents a number selected to provide a neutral molecule.

Next, the compounds represented by general formula (C) are described in detail below.

The aliphatic hydrocarbon group, the aryl group or the heterocyclic group represented by Rc has the same meaning as given for the corresponding groups represented by Ra in general formula (A). Rc is preferably an aryl group, more preferably a substituted or unsubstituted phenyl or naphthyl group, and still more preferably a phenyl group substituted by an electron attractive group, particularly by a halogen atom (particularly by a chlorine atom). Specific examples thereof include 4-chlorophenyl and 3,4-dichlorophenyl, and 3,4-dichlorophenyl is most preferred. Mc and $n_3$ have the same meanings as given for Mb and $n_2$, respectively, in general formula (B). Mc is preferably a hydrogen atom.

Next, the compounds represented by general formula (D) are described in detail below.

The aliphatic hydrocarbon groups, the aryl groups and the heterocyclic groups represented by $Rd_1$, $Rd_2$, $Rd_3$ and $Rd_4$ have the same meanings as given for the corresponding groups represented by Ra in general formula (A). $Rd_1$, $Rd_2$, $Rd_3$ and $Rd_4$ are preferably aryl groups, more preferably substituted or unsubstituted phenyl or naphthyl groups, and still more preferably phenyl groups. The cation represented by Md has the same meaning as given for the cation represented by Mb in general formula (B). Md is preferably an alkali metal ion, more preferably $Na^+$ or $K^+$, and still more preferably $Na^+$. $n_4$ has the same meaning as given for $n_2$ in general formula (B).

Next, the compounds represented by general formula (E) are described in detail below.

The aliphatic hydrocarbon group, the aryl group or the heterocyclic group represented by Re has the same meaning as given for the corresponding group represented by Ra in general formula (A). Re is preferably a heterocyclic group, more preferably a 5- or 6-membered unsaturated heterocyclic group, and still more preferably a 5- or 6-membered aromatic heterocyclic group. More preferably, Re is a 5- or 6-membered nitrogen-containing aromatic heterocyclic group, and particularly preferably a 5- or 6-membered aromatic heterocyclic group containing 1 to 4 nitrogen atoms.

Preferred examples of the heterocyclic ring corresponding to the heterocyclic group represented by Re include pyrrole, imidazole, pyrazole, pyridine, pyrimidine, pyrazine, pyridazine, triazole, triazine, indole, indazole, purine, thiazole, thiadiazole, oxazole, oxadiazole, quinoline, phthalazine, naphthyridine, quinoxaline, quinazoline, cinnoline, pteridine, tetrazole, benzimidazole, benzoxazole, benzothiazole, triazolotriazole, indolenine and tetraazaindene. The heterocyclic ring is more preferably imidazole, pyrimidine, triazole, thiazole, thiadiazole, oxazole, oxadiazole, tetrazole, benzimidazole, benzoxazole, benzothiazole or triazolotriazole, and particularly preferably pyrimidine, benzothiazole, triazolotriazole or tetrazole.

Me and $n_5$ have the same meanings as given for Mb and $n_2$, respectively, in general formula (B). Me is preferably a hydrogen atom or an alkali metal ion, and more preferably a hydrogen atom.

Next, the compounds represented by general formula (F) are described in detail below.

The nitrogen-containing heterocyclic ring formed by Q is a 3- to 10-membered saturated or unsaturated heterocyclic rings, which may be a monocyclic ring or may form a condensed ring with another ring.

The heterocyclic ring is preferably a 5- or 6-membered nitrogen-containing aromatic heterocyclic group, and more preferably a 5- or 6-membered aromatic heterocyclic group containing 1 to 5 nitrogen atoms.

Preferred examples of the nitrogen-containing heterocyclic rings formed by Q include pyrrole, imidazole, pyrazole, triazole, indole, isoindole, indazole, carbazole, perimidine, phenothiazine, phenoxazine, tetrazole, benzimidazole, benzotriazole and tetraazaindene. The nitrogen-containing heterocyclic ring is more preferably indazole, tetrazole, benzimidazole, benzotriazole or tetraazaindene, still more preferably indazole, tetrazole, benzimidazole or benzotriazole, and particularly preferably tetrazole or benzotriazole. In particular, 1H-tetrazole or an unsubstituted, halogen atom-substituted or nitro group-substituted benzotriazole is preferred.

Mf and $n_6$ have the same meanings as given for Mb and $n_2$, respectively, in general formula (B). Mf is preferably a hydrogen atom or an alkali metal ion, and more preferably a hydrogen atom.

Examples of the compounds represented by general formulae (A) to (F) are enumerated below, but the present invention should not be construed as being limited thereto.

A-1

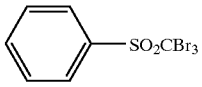

A-2

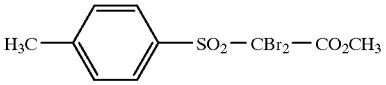

A-3

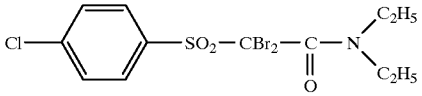

A-4

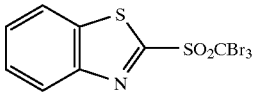

A-5

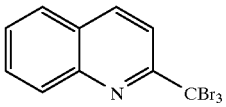

A-6

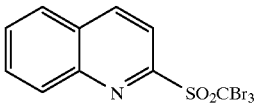

A-7

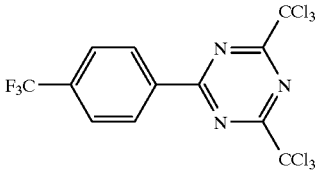

A-8

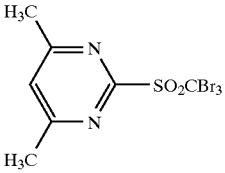

A-9

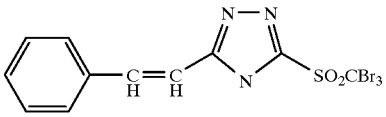

A-10

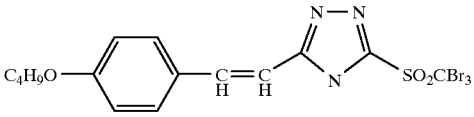

-continued

A-11

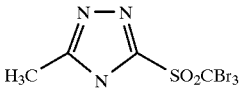

A-12

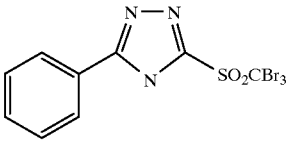

A-13

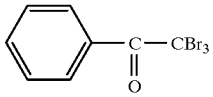

A-14

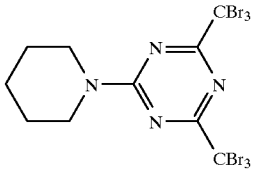

A-15

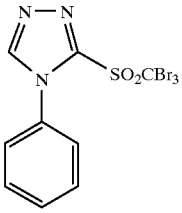

A-16

B-1

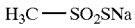

B-2

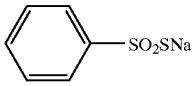

B-3

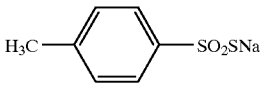

B-4

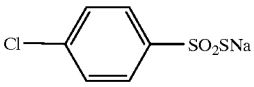

B-5

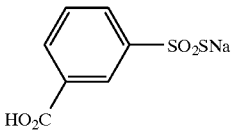

-continued
B-6
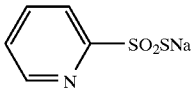
C-1
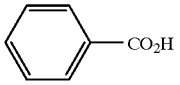
C-2
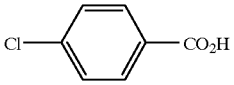
C-3
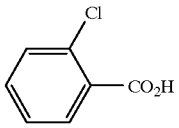
C-4
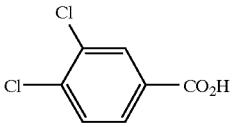
C-5
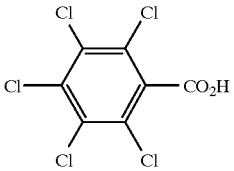
C-6
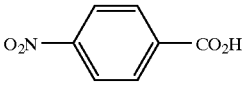
C-7
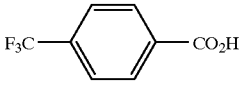
C-8
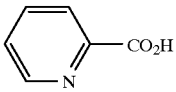
C-9
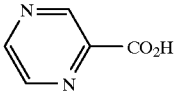
C-10
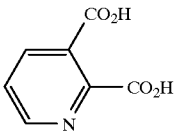
C-11
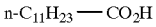
-continued
D-1
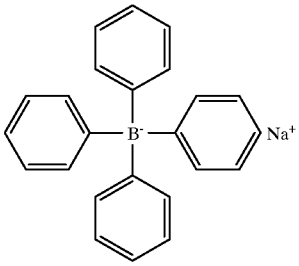
D-2
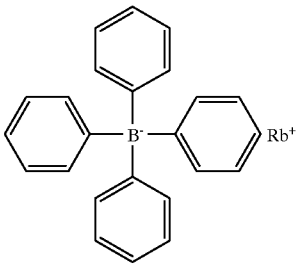
D-3
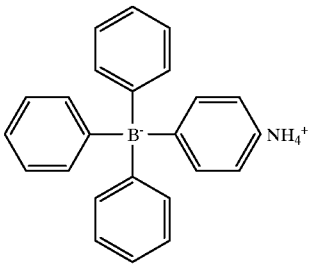
D-4
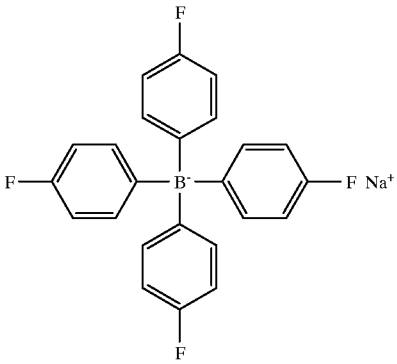
D-5
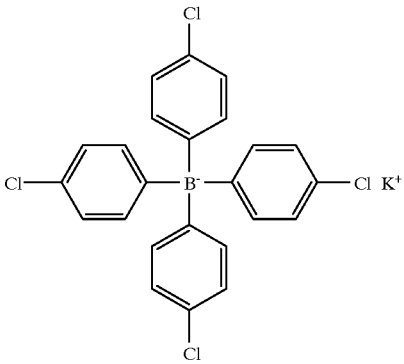

-continued
E-1
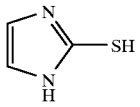
E-2
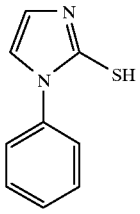
E-3
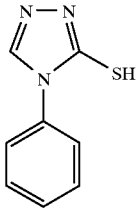
E-4
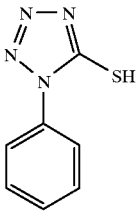
E-5
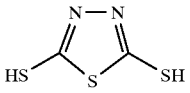
E-6
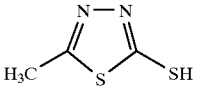
E-7
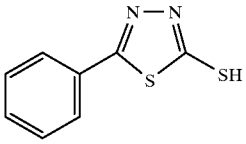
E-8
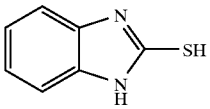
E-9
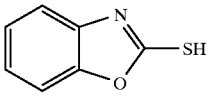
E-10
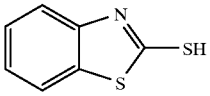
-continued
E-11
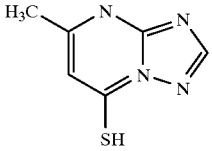
E-12
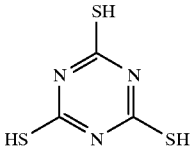
E-13
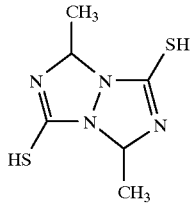
E-14
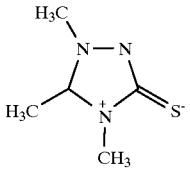
E-15
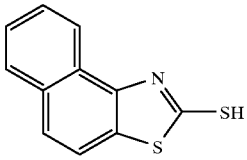
E-16
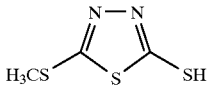
E-17
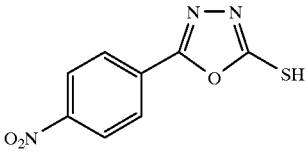
E-18
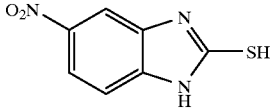
E-19
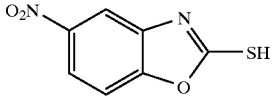
E-20
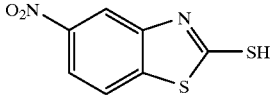

-continued

F-1

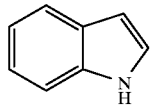

F-2

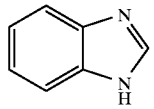

F-3

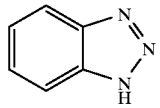

F-4

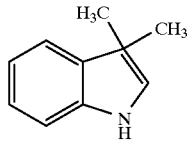

F-5

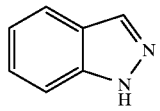

F-6

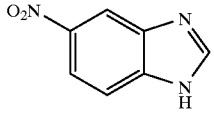

F-7

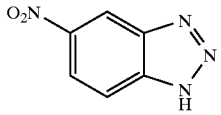

F-8

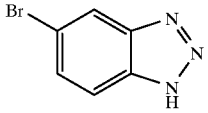

F-9

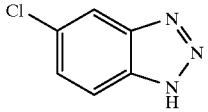

F-10

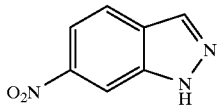

F-11

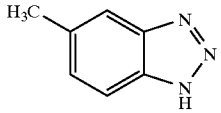

-continued

F-12

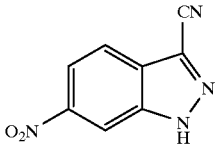

F-13

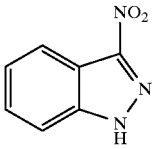

F-14

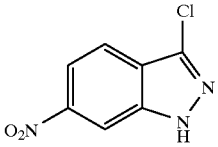

F-15

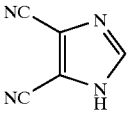

F-16

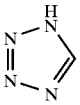

F-17

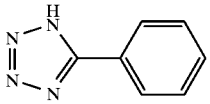

F-18

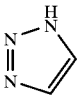

F-19

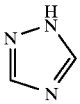

F-20

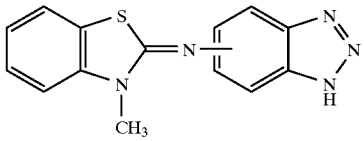

The organic silver salt contained in the recording layer of the recording material of the present invention is a light-stable, colorless or white silver salt, and produces silver by a redox reaction when heated together with a reducing agent, regardless of the presence or absence of an exposed silver halide. Such organic silver salts are silver salts of organic compounds having imino groups, mercapto groups or carboxyl groups, and specific examples thereof include the following silver salts:

1) Silver salts of organic compounds having imino groups:

Saccharin silver, phthalazinone silver, benzotriazole silver, etc.

2) Silver salts of organic compounds having mercapto groups or thione groups:

Silver salt of 3-(2-carbonylethyl)-4-oxymethyl-4-thiazoline-2-thione, silver salt of 3-mercapto-4-phenyl-1,2,4-triazole, etc.

3) Silver salts of organic compounds having carboxyl groups:

Silver stearate, silver behenate, etc.

Of these, silver behenate is most preferred in terms of whiteness and light stability. Silver behenate also has excellent moisture resistance, and can be used in combination with a reducing agent having a relatively week reducing ability. Furthermore, excellent toning agents are available for use in combination with silver behenate.

In the present invention, the organic silver salt is preferably used in terms of a solid dispersion. There is no particular limitation on methods for preparing the solid dispersion, and known methods can be used. Specifically, the organic silver salt may be dispersed together with a water-soluble polymer such as polyvinyl alcohol, and with a toning agent, an antifoggant, a surfactant and the like as needed, in a ball mill or a sand mill, to a size of several microns or less.

On the other hand, the developing agent is preferably used as a solid dispersion in a manner similar to the organic silver salt, or as solution obtained by completely dissolving the developing agent in an aqueous solution of a water-soluble polymer compound such as polyvinyl alcohol.

The recording material of the present invention can be used as a light-sensitive material by incorporating into the recording layer thereof a light-sensitive silver halide which forms a latent image on exposure and which can carry out a redox reaction with the organic silver salt, namely provide rapid development, adjacent the organic silver halide. In this case, the silver halide is appropriately selected from known silver halides such as silver chloride, silver bromide, silver chlorobromide, silver iodide, silver iodobromide and silver chloroiodobromide.

When the silver halide is arranged adjacent to the organic silver salt, a silver halide forming agent is preferably added to convert part of the organic silver salt to a silver halide, similar to the above-described dry silver.

The above silver halide forming agent includes inorganic halogen compounds such as KBr, KCl and HBr, onium halides such as $NH_4$, Br and $NH_4Cl$, and halogen donative compounds such as carbon halides and N-halides such as N-bromosuccinimide.

The developing agent for use in the present invention is a reducing agent which reduces the organic silver salt to form silver when heated, and must be able to rapidly conduct the reduction reaction at the development temperature and without affecting the color tone of the images after development.

Examples of the reducing agent include hydroxycoumarone or hydroxycoumaran compounds, sulfoamidophenol or sulfoamidonaphthol compounds, hydrazone compounds, hydroxamic acid compounds, bis-β-naphthol compounds, indane-1,3-dione compounds, aminophenol or aminonaphthol compounds, pyrazoline-5-one compounds, hydroxylamine compounds, reductons, hydrazine compounds, hydroquinone compounds, polyphenols such as bisphenol A and bisphenol B, gallic acid and gallates, phenylenediamine compounds, hydroxyindane compounds, 1,4-dihydroxypyridine compounds, amidoximes, aryl hydroxy-substituted aliphatic carboxylic acid arylhydrazides, N-hydroxyurea compounds, phosphon-amidophenol compounds, phosphonamidoaniline compounds, a-cyanophenylacetates and sulfonamidoaniline compounds. Of these, compounds represented by the following formulae, octyl gallate, propyl gallate, ethyl gallate and methyl gallate are preferred.

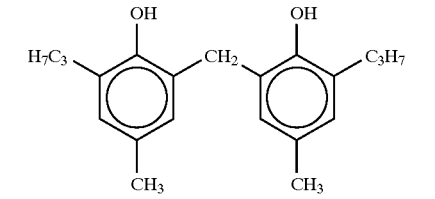

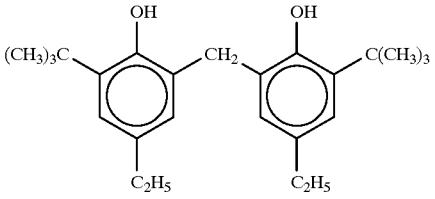

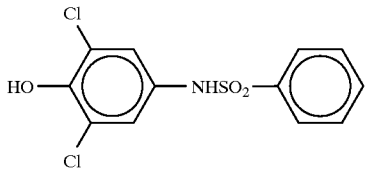

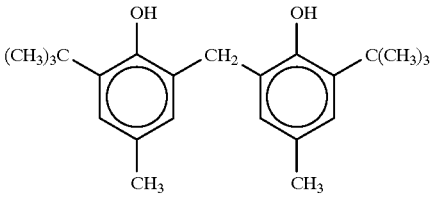

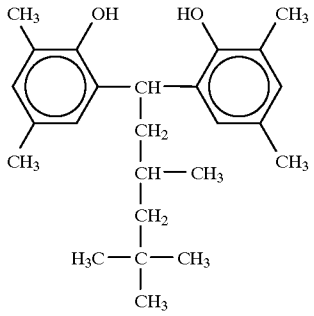

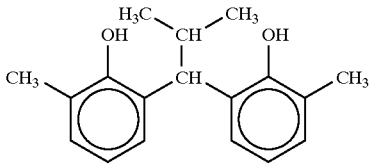

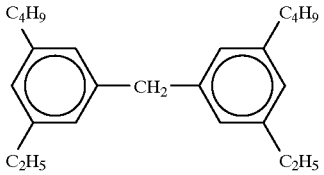

In the present invention, a toning agent is preferably added to the recording layer in order to accelerate the redox reaction between the organic silver salt and the developing agent upon heating, and to provide rapid development with adjustment of the image color tone.

The toning agent is preferably used when a dense image, particularly a black image, is desired. The addition amount thereof is about 0.0001 mol to about 2 mol, and preferably about 0.0005 mol to about 1 mol, per mol of the organic silver salt. Although the selection of an effective toning agent varies depending on the organic silver salt and the reducing agent that are used, the most ordinary toning agent is a heterocyclic organic compound containing at least two hetero-atoms, in which at least one nitrogen atom is contained in the heterocycle thereof.

Useful toning agents are described, for example, in U.S. Pat. No. 3,080,254. Specific examples of the toning agent include phthalazone (phthalazinone), phthalic anhydride derivatives, 2-acetylphthalazinone, 2-phthalylphthalazinone, and the substituted phthalazinone described in JP-A-50-67132 (the term "JP-A" as used herein means an "unexamined published Japanese patent application"), which toning agents are preferably used in the present invention.

Examples of other effective toning agents include pyrazoline-5-one compounds, cyclic imides and quinazoline described in JP-A-46-6077. Specific examples of these include phthalimide, N-hydroxyphthalimide and phthalimide silver. Phthalazinone compounds are also effective as the toning agent.

Other effective toning agents further include the mercapto compounds described in JP-A-49-5019 and JP-A-49-5020. In addition, the oxazinedione compounds described in JP-A-50-2542, the phthalazinedione compounds described in JP-A-50-67641, the uracil compounds described in JP-A-58-114217, the N-hydroxynaphthalimide compounds described in U.S. Pat. No. 3,782,941, the substituted phthalimide compounds described in West German Patent Publication Nos. 2,140,406, 2,141,063 and 2,220,597, and the phthalazinone derivatives described in West German Patent Publication (OLS) No. 2,220,618 can also be similarly used.

The water-soluble binder for use in the present invention has the function of binding the organic silver salt and the developing agent contained in the recording layer, and adheres the recording layer to a support. Such water-soluble binders include gelatin and/or gelatin derivatives (for example, phthalated gelatin), water-soluble polymers such as polyvinyl alcohol, methyl cellulose, carboxymethyl cellulose and hydroxypropyl cellulose, and various emulsions such as gum arabic, polyvinylpyrrolidone, casein, styrene-butadiene latexes, acrylonitrile-butadiene latexes, polyvinyl acetate, polyacrylic acid esters and ethylene-vinyl acetate copolymers.

The coating amount of the water-soluble binder is preferably from 0.5 to 5 g/m$^2$ in terms of solid content.

In addition to the above-described materials, citric acid, tartaric acid, oxalic acid, boric acid, phosphoric acid, pyrophosphoric acid or the like can be used as an acid stabilizer.

The organic silver salt for use in the present invention is preferably purified by desalting. The desalting purification includes, for example, removing nitrates from the system produced as a side product by the addition of silver nitrate, when silver nitrate is added to a reactive organic acid salt formed by adding an alkali to an organic acid to prepare the organic silver salt. The desalting purification is preferably conducted by an ultrafiltration method using a semipermeable membrane through which the organic silver salt is not passed but the nitrate is passed, or by a centrifugal separation method.

The support for use in the present invention may be either transparent or opaque. Opaque supports include paper, synthetic paper, polymer film-laminated paper, aluminum-deposited bases and white pigment-coated polymer films.

Transparent supports include, for example, polyester films such as polyethylene terephthalate, polyethylene naphthalate and polybutylene terephthalate, cellulose derivative films such as a cellulose triacetate film, polyolefin films such as a polystyrene film, a polypropylene film and a polyethylene film, polyimide films, a polyvinyl chloride film, a polyvinylidene film, polyacrylic acid copolymer films and polycarbonate films. These films may be used alone or as a laminate thereof. In particular, polyester films subjected to heat resistant treatment and antistatic treatment are preferred.

There is no particular limitation on methods for producing these films, as long as they are produced under such conditions so as to attain the above objectives. Specific examples thereof include a method in which a polymer is heat melted, extruded, cooled, solidified, drawn and heat set to produce a film.

The thickness of the support is from 20 to 300 $\mu$m, preferably 50 to 250 $\mu$m, and more preferably 60 to 150 $\mu$m. Thinner films lack mechanical strength and tend to pose handling problems. On the other hand, thicker films are not needed in order to further increase the mechanical strength.

The film for use as a transparent support of the recording material of the present invention preferably has a thickness of from 20 to 300 $\mu$m and a haze (cloudiness) of 3% or less.

Furthermore, the above-described supports may contain inorganic fine grains, antioxidants, antistatic agents, dyes and the like within a range such that the objectives of the present invention are not impaired.

The inorganic fine grains which can be incorporated into the support include oxides, hydroxides, sulfides, nitrides, halides, carbonates, acetates, phosphates, phosphites, organic carboxylates, silicates, titanates and borates, of elements of group IA, group IIA, group IVA, group VIA, group VIIA, group VIII, group IB, group IIB, group IIIB and group IVB, and hydrous compounds thereof, complex compounds mainly composed thereof and natural mineral grains. Specific examples thereof include compounds of the group IA elements such as lithium fluoride and borax (sodium borate hydrate), compounds of the group IIA elements such as magnesium carbonate, magnesium phosphate, magnesium oxide (magnesia), magnesium chloride, magnesium acetate, magnesium fluoride, magnesium titanate, magnesium silicate, magnesium silicate hydrate (talc), calcium carbonate, calcium phosphate, calcium phosphite, calcium sulfate (gypsum), calcium acetate, calcium terephthalate, calcium hydroxide, calcium silicate, calcium fluoride, calcium titanate, strontium titanate, barium carbonate, barium phosphate, barium sulfate and barium phosphite, compounds of the group IVA elements such as titanium dioxide (titania), titanium monoxide, titanium nitride, zirconium dioxide (zirconia) and zirconium monoxide, compounds of the group VIA elements such as molybdenum dioxide, molybdenum trioxide and molybdenum sulfide, compounds of the group VIIA elements such as manganese chloride and manganese acetate, compounds of the group VIII elements such as cobalt chloride and cobalt acetate, compounds of the group IB elements such as cuprous iodide, compounds of the group IIB elements such as zinc oxide and zinc acetate, compounds of the group IIIB elements such as aluminum oxide (alumina), aluminum fluoride and alumino-silicates (aluminum silicate, kaolin and kaolinite), compounds of the group IVB elements such as silicon oxide (silica and silica gel), plumbago, carbon, graphite and glass, and natural mineral grains such as carnallite, kainite, mica (mica and phlogopite) and pyrolusite. From the viewpoint of handling, silica, talc, titania, alumina, calcium oxide, calcium carbonate, calcium chloride and mixtures thereof are preferred.

Furthermore, the organic fine grains include fine grains such as crosslinked polystyrene and crosslinked polymethyl methacrylate grains. With respect to antioxidants, antistatic agents, dyes and the like, known additives for resins can be compounded therein according to the intended purpose.

In the present invention, when a polymer film or paper laminated therewith is used as a support, or when a transparent support is used, an undercoat layer is preferably provided between the support and the recording layer to enhance the adhesion therebetween.

Suitable materials for the undercoat layer include gelatin, synthetic polymer latexes, nitrocellulose and the like. The undercoat layer is preferably coated in a range of from 0.1 $g/m^2$ to 2.0 $g/m^2$, and particularly preferably from 0.2 $g/m^2$ to 1.0 $g/m^2$.

In some cases, the undercoat layer swells with water contained in the recording layer to deteriorate image quality when the recording layer is formed thereon. Therefore, a hardener is preferably used to harden the undercoat layer.

Suitable hardeners include, for example, those described in JP-A-2-141279. The addition amount of the hardener is appropriately selected depending on the coating method and the desired degree of hardening within a range of from 0.20% by weight to 3.0% by weight based on the weight of the undercoat layer.

Depending on the hardener used, it is also possible to shift the pH of the solution either to the basic side by adding sodium hydroxide or to the acidic side by adding citric acid or the like, if needed. Furthermore, it is also possible to add an antifoaming agent to prevent foam in the coating, or to add a surfactant to improve solution leveling and to prevent the generation of coating streaks.

Furthermore, it is desirable to subject the surface of the support to activation treatment by known methods before coating the undercoat layer. The activation treatment methods for use herein include etching treatment with acids, flame treatment with a gas burner, corona discharge treatment and glow discharge treatment. With respect to cost and simplicity, however, the corona discharge treatment described in U.S. Pat. Nos. 2.715,075, 2,846,727, 3,549,406 and 3,590,107 is preferred.

In the present invention, a pigment-containing protective layer is preferably provided on the recording layer to protect the recording layer from sticking, the action of solvents, or the like.

Suitable pigments include mica, talc, calcium carbonate, zinc oxide, titanium oxide, aluminum hydroxide, kaolin, agalmatolite, synthetic silicates, amorphous silica and urea-formalin resin powder. Of these, calcium carbonate, aluminum hydroxide, kaolin, silica, mica and talc are particularly preferred.

From the viewpoints of pigment retention and improved transparency, the protective layer of the present invention preferably contains completely saponified polyvinyl alcohol, carboxy-modified polyvinyl alcohol, silica-modified polyvinyl alcohol or the like as a binder.

A coating solution for the protective layer (hereinafter referred to as a protective layer solution) in the present invention is obtained by mixing the pigment with a solution of the above-described binder. However, a lubricant and a dispersing agent such as zinc stearate, calcium stearate, paraffin wax or polyethylene wax, and various auxiliaries such as a fluorescent brightening agent, a crosslinking agent, an alkali metal salt of sulfosuccinic acid and a fluorine-containing surfactant may further be added depending on the intended purpose.

The recording material of the present invention can be produced, for example, by preparing the coating solution for the recording layer containing an organic silver salt, a developing agent, a water-soluble binder and other additives as needed, and the coating solution for a protective layer, and coating the support with these coating solutions by a coating method such as bar coating, blade coating, air knife coating, gravure coating, roll coating, spray coating or dip coating. This is followed by drying to provide a recording layer having a coverage of 2.5 to 25 $g/m^2$ in solid weight and a protective layer having a coverage of 0.2 to 7 $g/m^2$ in terms of solid weight.

The coating amounts of the organic silver salt and the developing agent each is preferably 0.5 to 3.0 $g/m^2$, and particularly preferably 0.8 to 2.0 $g/m^2$. The coating amount of the organic silver salt is given in terms of the silver content of the recording layer.

Known pigments, dispersing agents, thickeners, fluid modifiers, antifoaming agents, foam inhibitors, mold releasing agents and coloring agents can be appropriately added to the coating solutions for use in the present invention as needed, as long as the objectives of the present invention are achieved.

Furthermore, a back coat layer may be provided on the side opposite of the support opposite that having the color developing layer as needed. The back coat layer can be selected without particular limitation from among known back coat layers for recording materials.

The present invention is described in detail below with reference to the following Examples, but the invention should not be construed as being limited thereto. Unless otherwise indicated, all "%" and "parts" are by weight.

EXAMPLE 1

Preparation of Silver Behenate

To 200 g of water, 10.59 g of behenic acid was added and heated to 90° C. Then, an aqueous solution containing 1.06 g of NaOH dissolved in 26.5 g of water was added thereto and thoroughly stirred, followed by cooling to 50° C.

Then, an aqueous solution containing 4.30 g of $AgNO_3$ dissolved in 25.3 g of water was added dropwise to the resulting solution for 5 minutes, and thereafter stirring was continued for 30 minutes to conduct the reaction.

The resulting reaction solution was filtered through a filter cloth, and 800 ml of water was added thereto. After stirring and washing, the solution was filtered again. This washing operation was repeated three times, and then, the resulting solid components were dried with an air blowing drier at 50° C. for 3 days to obtain a dried silver behenate solid (85.0% by weight as silver behenate).

Preparation of Co-Dispersion of Silver Behenate/ Phthalazone

From the dried solid silver behenate thus obtained, 21.1 g was weighed. Then, 3.3 g of phthalazone, 52.8 g of a 15% aqueous solution of polyvinyl alcohol (PVA 205, manufactured by Kuraray Co., Ltd.) and 103 g of ion-exchanged water were added thereto, and dispersed in a sand mill (manufactured by Shinmaru Enterprises Co., Ltd., using glass beads having a diameter of 0.5 to 0.75 mm) for 3 hours to obtain a co-dispersion of silver behenate/phthalazone having a mean grain size of 0.7 $\mu$m or less.

Preparation of Antifoggant Solution

To 10 g of acetonitrile, 0.3 g of a compound represented by formula (1) shown below was added, and dissolved by stirring to obtain an antifoggant solution.

Preparation of Aqueous Solution of Developing Agent

To 50.0 g of 22% polyvinyl alcohol (PVA 203, manufactured by Kuraray Co., Ltd.), 2.4 g of methyl gallate, 2.4 g of ethyl gallate and 35.0 g of ion-exchanged water were added, and stirred at 50° C. for 1 hour to prepare an aqueous solution of a developing agent.

Preparation of Coating Solution for Thermal Recording Layer

Six grams of the above co-dispersion of silver behenate/phthalazone, 2.7 g of the above aqueous developing agent solution and 2.2 g of the above antifoggant solution were added, and mixed by stirring to obtain a coating solution for a thermal recording layer.

Preparation of Coating Solution for Protective Layer

Five grams of a 2% aqueous solution of polyoxyethylene (surfactant) and 4 g of a 20% dispersion of zinc stearate (Hydrin Z: trade name, manufactured by Chukyo Yushi Co., Ltd.) were added to a solution containing 32 g of water, 32 g of a 10% aqueous solution of carboxy-modified polyvinyl alcohol (PVA-KL-318: trade name, manufactured by Kuraray Co., Ltd.) and 3 g of a 30% dispersion of an epoxy-modified polyamide (FL-71: trade name, manufactured by Toho Chemical Industry Co., Ltd.), to thereby obtain a coating solution for a protective layer.

Preparation of Recording Material

A transparent polyethylene terephthalate support (having a thickness of 130 $\mu$m) provided with an undercoat layer was coated with the above coating solution for a recording layer using a wire bar so as to obtain a coated amount of silver behenate of 3.2 g/m$^2$, and dried at 50° C. for 20 minutes.

Then, the coating solution for the protective layer was further applied on this coated film in a solid amount of 2.0 g/m$^2$, and dried to obtain a recording material.

Heat Recording and Evaluation of Shelf Life

The resulting recording materials just after preparation were stored under conditions of 60° C. and 30% RH (relative humidity) for 1 day (deterioration test), and were heat recorded in the following manner.

Images were recorded on the recording materials thus obtained with a thermal head Type KST (trade name, manufactured by Kyocera Corp.) by adjusting the applied voltage and pulse width so that the recording thermal energy per unit area was 60 mJ/mm$^2$. The optical transparent density of the maximum color-developed areas and background areas (the minimum color-developed areas) was measured using a Macbeth densitometer (using a yellow filter for the color-developed areas, and an ultraviolet filter for the background areas). The results are shown in Table 1.

EXAMPLE 2

A recording material was prepared in the same manner as in Example 1, except that a compound of formula (2) was used as the antifoggant in place of the compound of formula (1). Images were recorded and the shelf life was evaluated in the same manner as in Example 1. The results are shown in Table 1.

EXAMPLE 3

A recording material was prepared in the same manner as in Example 1, except that a compound of formula (3) was used as the antifoggant in place of the compound of formula (1). Images were recorded and the shelf life was evaluated in the same manner as in Example 1. The results are shown in Table 1.

EXAMPLE 4

A recording material was prepared in the same manner as in Example 1, except that a compound of formula (4) was used as the antifoggant in place of the compound of formula (1), and methanol was used in place of acetonitrile in preparing the antifoggant. Images were recorded and the shelf life was evaluated in the same manner as in Example 1, except that the recording material was stored at 40° C. and 90% RH. The results are shown in Table 2.

EXAMPLE 5

A recording material was prepared in the same manner as in Example 1, except that a compound of formula (5) was used as the antifoggant in place of the compound of formula (1), and methanol was used in place of acetonitrile in preparing the antifoggant. Images were recorded and the shelf life was evaluated in the same manner as in Example 1, except that the recording material was stored at 40° C. and 90% RH. The results are shown in Table 2.

EXAMPLE 6

A recording material was prepared in the same manner as in Example 1, except that a compound of formula (6) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 7

A recording material was prepared in the same manner as in Example 1, except that a compound of formula (7) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 8

A recording material was prepared in the same manner as in Example 1, except that a compound of formula (8) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 9

A recording material was prepared in the same manner as in Example 1, except that a compound of formula (9) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 10

A recording material was prepared in the same manner as in Example 1, except that a compound of formula (10) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 11

A recording material was prepared and evaluated in the same manner as in Example 6, except that 0.13 g of a compound of formula (11) was used in place of 0.3 g of the compound of formula (6) in preparing the antifoggant. The results are shown in Table 3.

EXAMPLE 12

A recording material was prepared in the same manner as in Example 1, except that a compound of formula (12) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 13

A recording material was prepared in the same manner as in Example 1, except that a compound of formula (13) was used as the antifoggant in place of the compound of formula (1), and methanol was used in place of acetonitrile in preparing the antifoggant. Images were recorded and the shelf life was evaluated in the same manner as in Example 1, except that the evaluation was also carried out under conditions of 40° C. and 90% RH in addition to the storage conditions of 60° C. and 30% RH used in Example 1. The results are shown in Table 3.

EXAMPLE 14

A recording material was prepared and evaluated in the same manner as in Example 6, except that 0.27 g of a compound of formula (14) was used in place of 0.3 g of the compound of formula (6), in preparing the antifoggant. The results are shown in Table 3.

Comparative Example 1

A recording material was prepared and evaluated in the same manner as in Example 6, except that no antifoggant was used. The results are shown in Tables 1, 2 and 3.

Comparative Example 2

A recording material was prepared and evaluated in the same manner as in Example 11, except that the amount of the compound of formula (11) was changed from 0.13 g to 0.03 g in preparing the antifoggant. The results are shown in Table 3.

Comparative Example 3

A recording material was prepared and evaluated in the same manner as in Example 11, except that the amount of the compound of formula (11) was changed from 0.13 g to 0.30 g in preparing the antifoggant. The results are shown in Table 3.

(1)

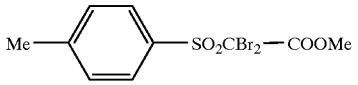

(2)

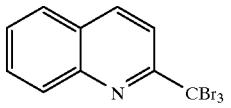

(3)

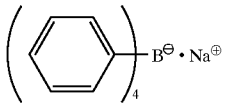

(4)

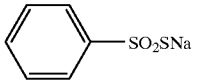

(5)

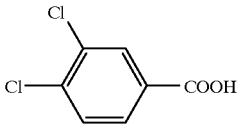

(6)

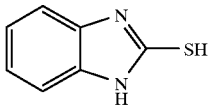

(7)

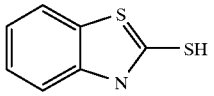

(8)

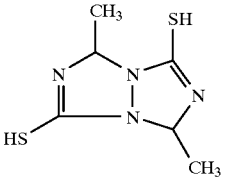

-continued (9)

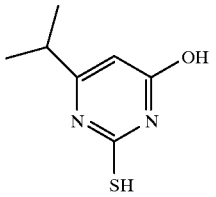

(10)

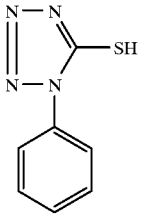

(11)

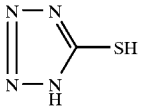

-continued (12)

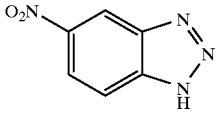

(13)

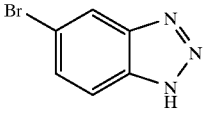

(14)

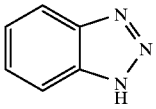

TABLE 1

| | Anti-foggant | Mol % Based on Silver Behenate | Background Area: Just after Preparation | Background Area: 60° C./30% One Day | Color-Developed Area: Just after Preparation |
|---|---|---|---|---|---|
| Example 1 | Compound 1 | 12.3 | 0.06 | 0.10 | 3.1 |
| Example 2 | Compound 2 | 12.5 | 0.09 | 0.14 | 2.8 |
| Example 3 | Compound 3 | 13.8 | 0.10 | 0.16 | 3.4 |
| Compara. Example 1 | Not added | — | 0.05 | 0.28 | 3.6 |

TABLE 2

| | Anti-foggant | Mol % Based on Silver Behenate | Background Area: Just after Preparation | Background Area: 60° C./30% One Day | Color-Developed Area: Just after Preparation |
|---|---|---|---|---|---|
| Example 4 | Compound 4 | 24.2 | 0.05 | 0.19 | 2.0 |
| Example 5 | Compound 5 | 24.8 | 0.06 | 0.21 | 2.8 |
| Compara. Example 1 | Not added | — | 0.05 | 0.28 | 3.6 |

TABLE 3

| | Anti-foggant | Mol % Based on Silver Behenate | Backround Area Just after Preparation | Backround Area 40° C./90% One Day | Backround Area 60° C./30% One Day | Color-Developed Area Just after Preparation |
|---|---|---|---|---|---|---|
| Example 6 | Compound 6 | 31.5 | 0.04 | 0.04 | 0.05 | 1.6 |
| Example 7 | Compound 7 | 28.3 | 0.05 | 0.05 | 0.07 | 2.7 |
| Example 8 | Compound 8 | 23.4 | 0.04 | 0.04 | 0.06 | 2.1 |
| Example 9 | Compound 9 | 27.8 | 0.05 | 0.06 | 0.05 | 2.2 |
| Example 10 | Compound 10 | 26.6 | 0.04 | 0.04 | 0.12 | 2.0 |
| Example 11 | Compound 11 | 30.1 | 0.05 | 0.06 | 0.08 | 2.9 |
| Example 12 | Compound 12 | 28.9 | 0.05 | 0.05 | 0.06 | 3.5 |
| Example 13 | Compound 13 | 23.9 | 0.04 | 0.09 | 0.07 | 2.8 |
| Example 14 | Compound 14 | 35.4 | 0.04 | 0.05 | 0.07 | 2.4 |
| Comparative Example 1 | Not added | — | 0.05 | 0.53 | 0.28 | 3.6 |
| Comparative Example 2 | Compound 11 | 7.5 | 0.05 | 0.50 | 0.24 | 3.5 |
| Comparative Example 3 | Compound 11 | 75.2 | 0.05 | 0.05 | 0.05 | 0.9 |

The above results show that the recording material of the present invention exhibits only a slight increase in background area color even after storing under high temperature and humidity conditions (deterioration test), while maintaining excellent color development density and long shelf life as compared with conventional materials.

As described above, the recording material of the present invention also provides excellent dynamic color development, in addition to having an extremely long shelf life as compared with conventional materials.

While the invention has been described in detail and with reference to specific examples thereof, it will be apparent to one skilled in the art that various changes and modifications can be made therein without departing from the spirit and scope thereof.

What is claimed is:

1. A recording material comprising a support having thereon a recording layer comprising silver behenate, a developing agent for the silver behenate, a water-soluble binder and an antifoggant in an amount of from 10 mol % to 40 mol % based on said silver behenate; wherein the antifoggant is at least one compound selected from the group consisting of compounds represented by the following formulae (A) to (F):

Formula (A)

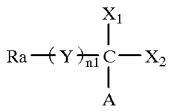

Formula (B)

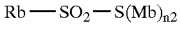

Formula (C)

Formula (D)

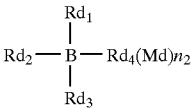

-continued

Formula (E)

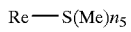

Formula (F)

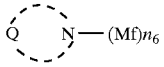

wherein in formula (A), Ra represents a substituted or unsubstituted aliphatic hydrocarbon group, aryl group or heterocyclic group, Y represents —CO—, —SO—, or —$SO_2$—, $n_1$ represents 0 or 1, $X_1$ and $X_2$ each represents a halogen atom, and A represents a hydrogen atom or an electron attractive group; in formula (B) Rb represents a substituted or unsubstituted aliphatic hydrocarbon group, aryl group or heterocyclic group, Mb represents a hydrogen atom or a cation, and $n_2$ represents a number selected to provide a neutral molecule; in formula (C), Rc represents a substituted or unsubstituted aliphatic hydrocarbon group, aryl group or heterocyclic group, Mc represents a hydrogen atom or a cation, and $n_3$ represents a number selected to provide a neutral molecule; in formula (D), $Rd_1$, $Rd_2$, $Rd_3$ and $R_4$ each represents a substituted or unsubstituted aliphatic hydrocarbon group, aryl group or heterocyclic group, Md represents a cation, and $n_4$ represents a number selected to provide a neutral molecule; in formula (E), Re represents a substituted or unsubstituted aliphatic hydrocarbon group, aryl group or heterocyclic group, Me represents a hydrogen atom or a cation, and $n_5$ represents a number selected to provide a neutral molecule; and in formula (F), Q represents an atomic group which forms a nitrogen-containing heterocyclic group, Mf represents a hydrogen atom or a cation, and $n_6$ represents a number selected to provide a neutral molecule.

2. The recording material as claimed in claim 1, wherein the recording layer contains the antifoggant in an amount of from 20 mol % to 40 mol % based on said organic silver salt.

3. The recording material as claimed in claim 1, wherein the antifoggant is at least one compound selected from the group consisting of compounds represented by formulae (E) and (F).

4. The recording material as claimed in claim 1, wherein the recording layer further comprises a light-sensitive silver halide.

* * * * *